US006377648B1

(12) United States Patent
Culbert

(10) Patent No.: US 6,377,648 B1
(45) Date of Patent: Apr. 23, 2002

(54) PILL COUNTER AND METHOD OF COUNTING PILLS

(76) Inventor: Carolyn Seals Culbert, 2619 N. 12th St., Kansas City, KS (US) 66104

( * ) Notice: Subject to any disclaimer, the term of this patent is extended or adjusted under 35 U.S.C. 154(b) by 0 days.

(21) Appl. No.: 09/814,665

(22) Filed: Mar. 22, 2001

Related U.S. Application Data

(63) Continuation-in-part of application No. 09/476,806, filed on Mar. 28, 2000, now abandoned.
(60) Provisional application No. 60/091,850, filed on Jul. 6, 1998.

(51) Int. Cl.[7] ..... G06M 11/00
(52) U.S. Cl. ..... 377/6

(58) Field of Search ..... 377/6

(56) References Cited

U.S. PATENT DOCUMENTS 3,837,139 A * 9/1974 Roseberg ..... 53/59 R
3,848,395 A * 11/1974 Totten ..... 53/35

* cited by examiner

*Primary Examiner*—Margaret R. Wambach
(74) *Attorney, Agent, or Firm*—Stinson, Mag & Fizzell, P.C.

(57) ABSTRACT

The present invention is directed to a pill-counting machine and method of counting pills that uses a rotatable first pill rotor having a plurality of holes, a second pill rotor having a single orifice and a rotatable third pill rotor having a plurality of chambers.

11 Claims, 5 Drawing Sheets

PILL COUNTER AND METHOD OF COUNTING PILLS

RELATED APPLICATIONS

This application is a continuation-in-part of the nonprovisional application Ser. No. 09/476,806 filed Mar. 28, 2000 now abandoned and the provisional application, Ser. No. 60/091,850 filed on Jul. 6, 1998.

BACKGROUND OF THE INVENTION

1. Field of the Invention

The present invention relates to pill counters for use by druggists or pharmacists in dispensing a predetermined number of pills, capsules or tablets into a prescription bottle from a stock bottle.

2. Description of the Prior Art

When dispensing a prescription for a medicament which is formulated as unit doses, e.g., in the form of pills, tablets, capsules, dragees or the like, the pharmacist has to remove the required number of unit doses from a bulk supply and place them in a smaller container. It is important that the counting is as accurate as possible, since the prescription is generally designed to last for a specific period of time, and the patient will become anxious if there are either too few or too many dosage units to complete the course of treatment which his physician has suggested.

The most widely used device employed by pharmacists for counting out pills and capsules, or more generally tablets, is a simple flat tray having a collecting bin positioned along one side margin thereof. A bulk supply of tablets is poured onto the tray and the desired amount counted into the bin using a conventional spatula technique. Once counted, the segregated tablets in the bin must be somehow placed in a prescription bottle without spilling the overage remaining on the tray. This oftentimes proves to be rather difficult. Although this type of tray is simple in construction and can be easily handled, the number of tablets that can be processed at one time is generally limited. Similarly, any moderate displacement of the tray can cause spillage or commingling of already separated tablets with the bulk. In recent years a number of mechanical and/or electrical pill dispensing devices have been developed. Typical prior art devices of this type include those described in U.S. Pat. Nos. 792,918; 707,062; 2,771,198; 2,812,076; 2,863,572; 3,150,785; 3,206,062; 3,290,488; 3,386,618; 3,402,827; 3,662,904; 3,677,437; 3,746,211; 3,837,139 and 3,848,395.

It is an object of the present invention to provide an apparatus for counting small articles such as pills. For convenience the term "pill" will be used herein to cover tablets, capsules, dragees and other unit dose pharmaceutical formulations for oral administration.

SUMMARY OF THE INVENTION

It is an object of this invention to provide a pill counter capable of being operated at relative high speeds to expedite the counting of pills.

In accordance with the present invention, the foregoing objective is realized by providing a pill counting machine comprising an outer casing, a funnel and three pill rotors. The three pill rotors are capable of rotating at predetermined synchronized speeds in order to sort the pills into pill bottles. The first and third rotors each contain a plurality of holes/chambers spaced equidistantly and radially from the center of each rotor. The second rotor contains a single orifice.

BRIEF DESCRIPTION OF THE DRAWINGS

Other objects and advantages of the invention will become apparent upon reading the following detailed description and upon reference to the drawings.

DETAILED DESCRIPTION OF THE INVENTION

Figure 1:
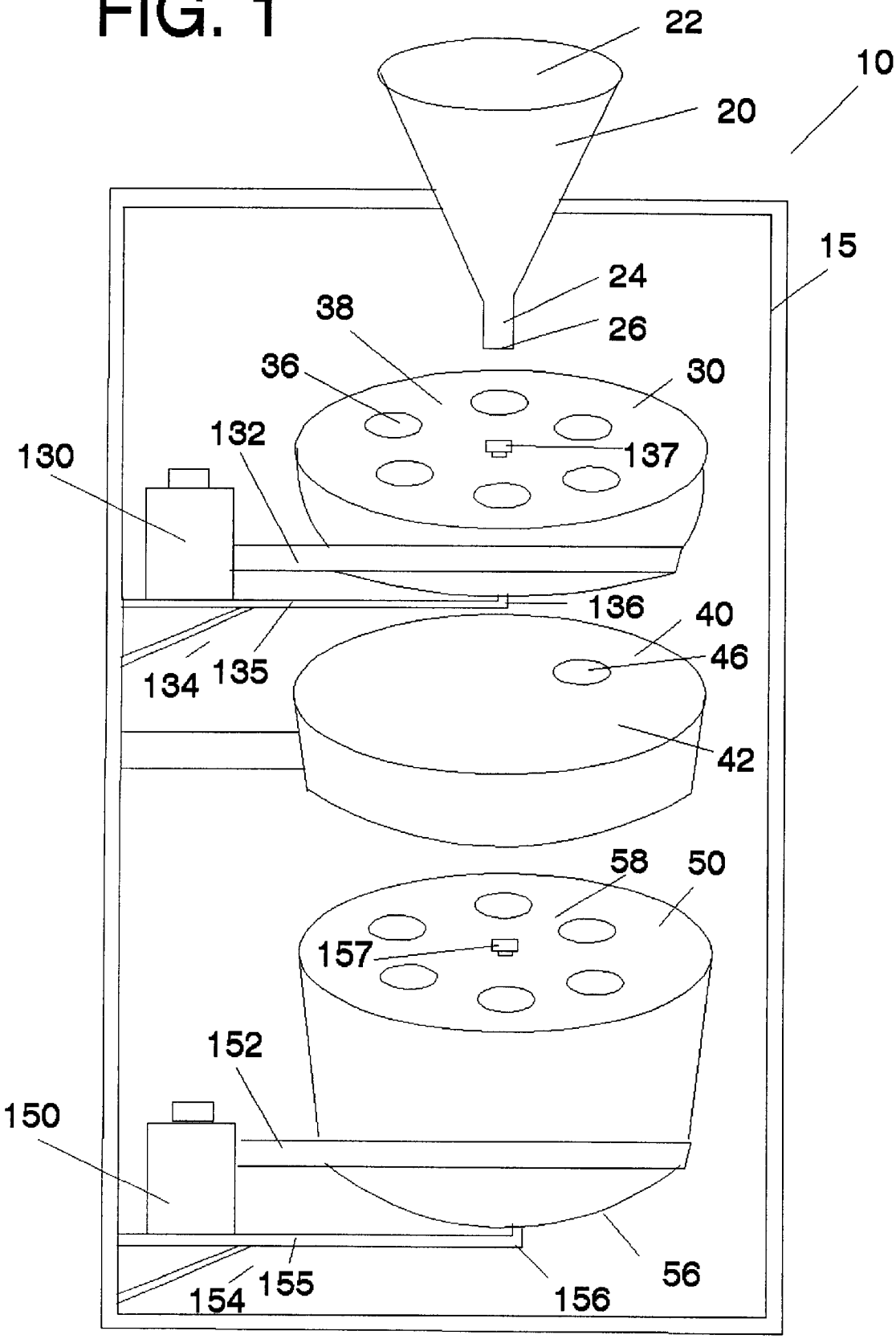
FIG. 1 is an expanded view of the pill counter of the present invention having a stationary second pill rotor.

Turning now to the drawings, the pill sorter apparatus 10 of the present invention is contained in a housing 15. The housing 15 may be plastic or metal. The housing is preferably rectangular in shape, but may be any shape and size sufficient to contain the other components of the pill sorter apparatus 10.

The pill sorter has a funnel 20 for receiving the pills in bulk. The funnel 20 may be made of plastic, metal or similar material that is rigid and does not chemically react with a pill. The funnel 20 has a wide pill-receiving portion 22 and a neck portion 24 is used to receive the pills. The neck portion 24 has an opening 26. The funnel 20 may also be a hopper-type device generally known to those skilled in the art.

Figure 2:
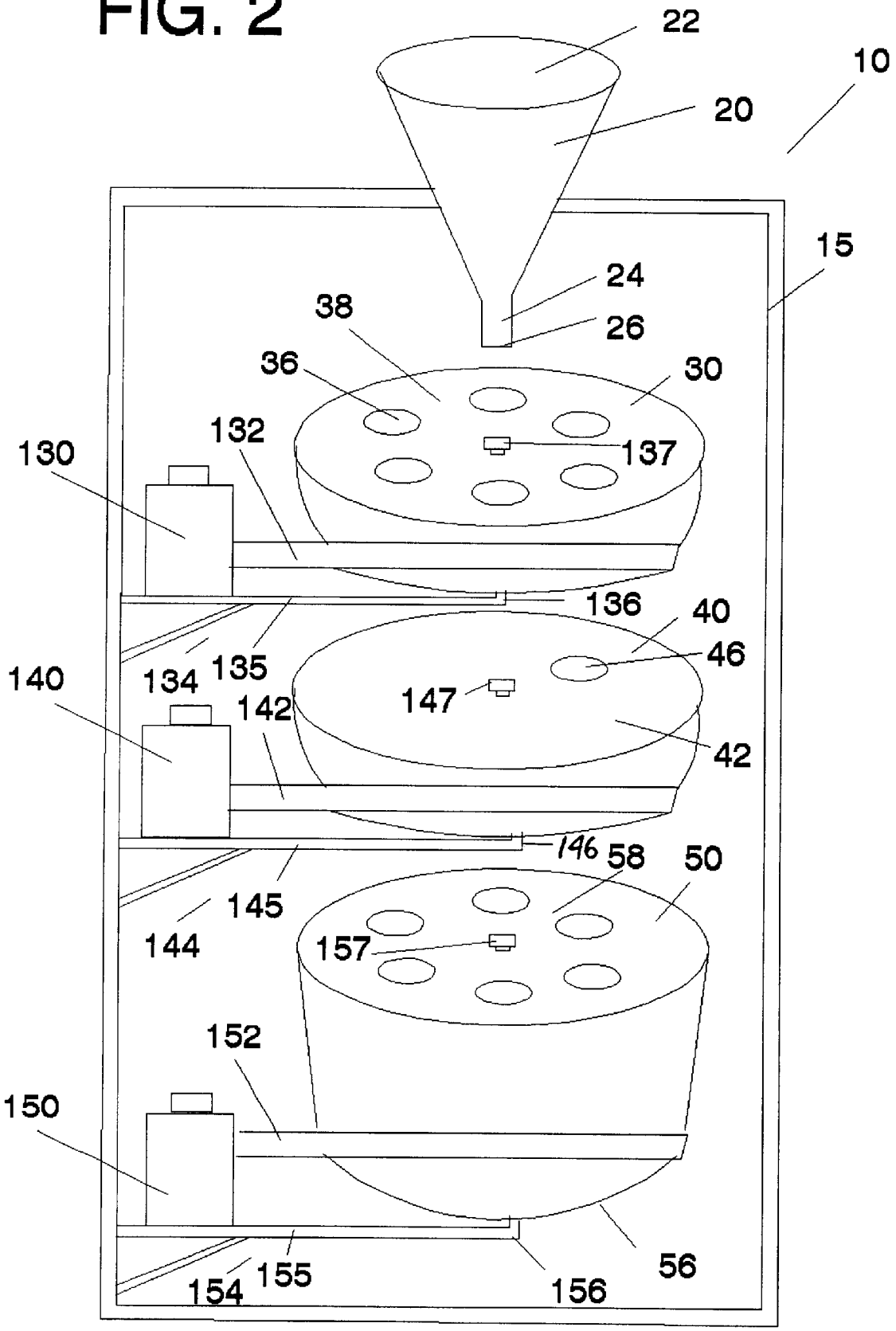
FIG. 2 is an expanded view of the pill counter of the present invention having a second pill rotor rotatably mounted.

As shown in FIGS. 1 and 2, the pill sorter of the present invention contains three rotors 30, 40 and 50. In the preferred embodiment, the rotors are comprised of an inert hard plastic or similar material. The rotors may also be comprised of other inert metals, such as stainless steel.

Figure 3A:
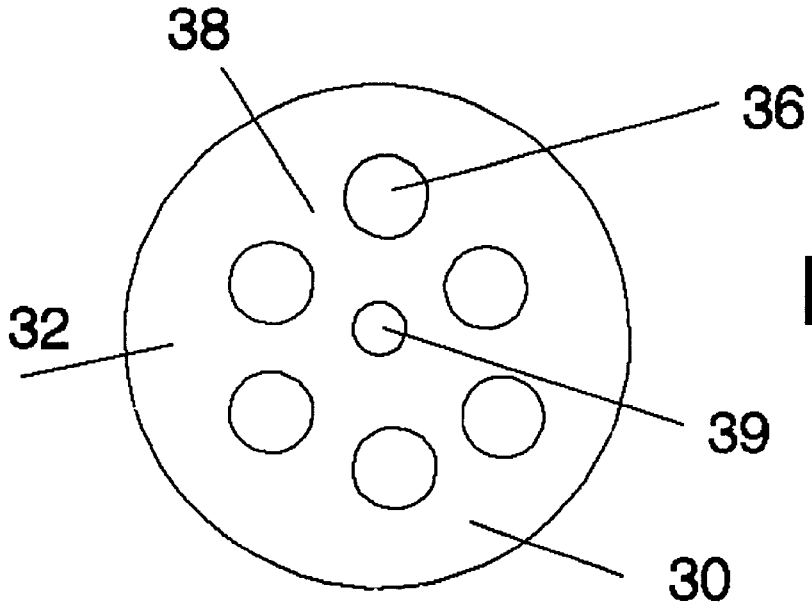
FIG. 3*a* is a top view of the first pill rotor.
Figure 3B:
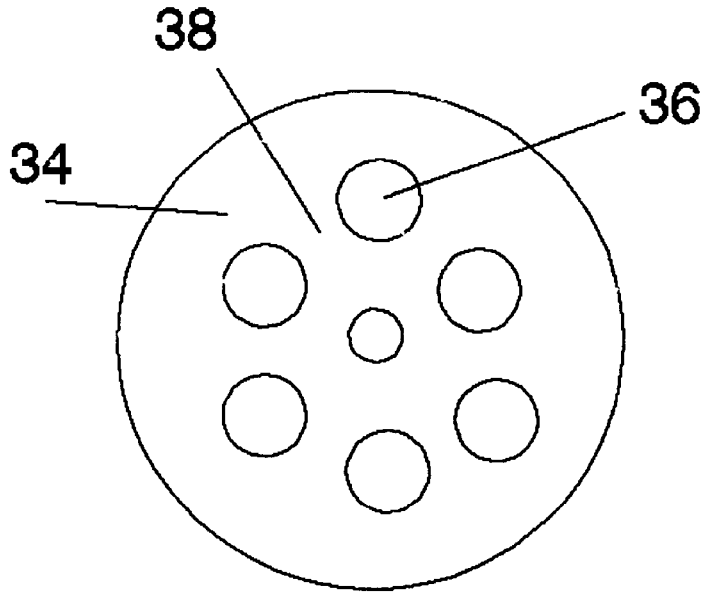
FIG. 3*b* is a bottom view of the first pill rotor.

A first pill rotor 30 is rotatably positioned just beneath the opening 26 of the neck portion 24 but does not contact the neck portion 24. The gap between the neck portion 24 of the funnel 20 and the first pill rotor 30 ranges from 0.01 to 1.0 cm, and is preferably about 0.5 cm. The gap is such that a pill cannot slide between the opening 26 and the first pill rotor 30. The pill rotor 30 is short, preferably cylindrically shaped, and comprised of hardened injection-molded plastic or metal, such as stainless steel. The first pill rotor 30 is approximately 3.0 to 15.0 cm in diameter and has a depth ranging from 1.0 to 5.0 cm. In the preferred embodiment, the first pill rotor 30 has a diameter of 7.0 cm and a depth of 3.5 cm. As shown in FIGS. 3*a* and 3*b*, the first pill rotor 30 has a top surface 32 and a bottom surface 34. It also contains a plurality of holes 36 (preferably six holes) that extend from the top surface 32 to the bottom surface 34, each hole 36 for collecting a single pill. The holes 36 range from 0.5 to 2.0 cm in diameter and are preferably 1.0 cm in diameter. A plurality of top and bottom interhole surfaces 38 are located between the holes 36. The holes 36 are positioned equidistant from the center of the first pill rotor 30. In the preferred embodiment, the center of each hole 36 is located about 2.5 cm from the center of the first rotor 30. As the first pill rotor 30 rotates, each of the holes 36 of the rotor 30 is consecutively positioned beneath the opening 26 of the neck portion 24 of the funnel 20. Thus, at any given time the opening 26 of the funnel 20 may be completely engaged with the top interhole surface 38 of the first rotor 30, partially engaged by the top interhole surface 38 of the first rotor 30, or completely engaged by a hole 36 in the first rotor 30.

The first pill rotor 30 is preferably rotated by a motor 130 and belt 132. The motor 130 can be an AC or a DC motor. In the preferred embodiment, the motor 130 is a DC motor with the capability of delivering variable revolutions per minute. The direction of the motor 130 can be changed such that the motor 130 can act upon the rotor 30 disc to decelerate the disc in addition to accelerating it. The motor 130 may also have a braking mechanism that is connected to the motor 130 or to the rotor 30 to assist in decelerating the rotor 30.

The first pill rotor 30 is mounted on a first mounting piece 134. The first mounting piece 134 contains a horizontal portion 135 and vertical portion 136. See FIGS. 1 and 2. The mounting piece 134 should be of sufficient sturdiness and thickness such that it adequately supports the weight of the first rotor 30 when it is spinning at its highest speed. A center hole 39 in the first rotor 30 is rotatably connected to the vertical portion 136 of the first mounting piece 134. The top of the vertical portion 136 may contain a cap 137 that precludes the first pill rotor 30 from flying off the mounting piece 134 when the rotor 30 is spinning. The cap 137 may be removable, such as a nut or some equivalent structure.

Figure 4A:
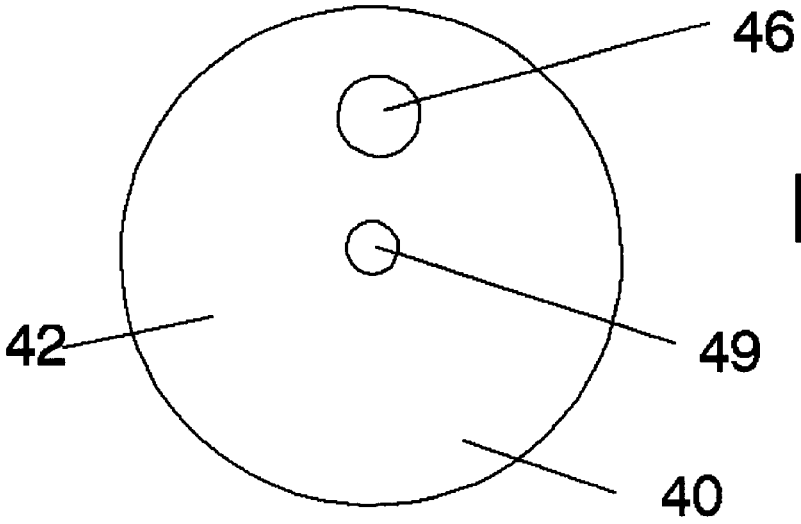
FIG. 4*a* is a top view of the second pill rotor.
Figure 4B:
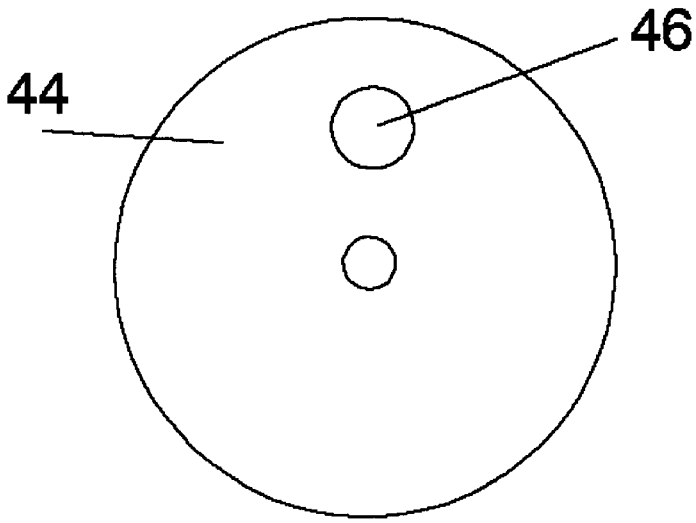
FIG. 4*b* is a bottom view of the second pill rotor.

Directly below the first pill rotor 30 is a second pill rotor 40 with overall dimensions similar to that of the first pill rotor 30. A first/second rotor gap of 0.05 to 2.0 cm (preferably 0.1 to 1.0 cm) is between the two rotors. As shown in FIGS. 4*a* and 4*b*, the second pill rotor 40 also has a top surface 42 and a bottom surface 44. The second pill rotor 40 is also cylindrical in shape. Unlike the first pill rotor 30 which has a plurality of holes 36, the second pill rotor 40 contains a single orifice 46 that extends from the top surface 42 to the bottom surface 44 of the second pill rotor 40. The orifice 46 ranges from 0.5 to 2.0 cm in diameter and is preferably about 1.0 cm in diameter. As shown in FIG. 1, the second pill rotor 40 is stationary. As the first rotor 30 moves about its axis, the holes 36 in the first rotor 30 are consecutively positioned above the single orifice 46 of the second rotor 40.

Alternatively, as shown in FIG. 2, the second pill rotor 40 is preferably rotated by a motor 140 and belt 142. The motor 140 can be an AC or a DC motor similar to that used to drive the first pill rotor 30. As with the first rotor motor 130, the direction of the motor 140 can be changed such that the motor 140 can act upon the rotor 40 disc to decelerate the disc in addition to accelerating it. A braking mechanism may also be connected to the motor 140 or to the rotor 40 to assist in decelerating the second pill rotor 40. Rotation of the second pill rotor 40 may be used in order to expedite counting of the pills.

If the second pill rotor 40 is stationary as shown if FIG. 1, the second pill rotor 40 is mounted on a second mounting piece 144. The mounting piece 144 may simply connect to the second pill rotor 40 at any position. If the second pill rotor 40 is rotatably mounted as shown in FIG. 2, the second pill rotor 40 is preferably mounted on a second mounting piece 144 that has a horizontal portion 145 and vertical portion 146. Again, it is important that the mounting piece 144 be of sufficient sturdiness and thickness such that it adequately supports the weight of the second rotor 40 when it is spinning at its highest speed.

If the second pill rotor 40 is rotatably mounted, a center hole 49 in the second rotor 40 is rotatably connected to the vertical portion 146. The top of the vertical portion 146 may contain a cap 147 that precludes the second pill rotor 40 from flying off the mounting piece 144 when the rotor 40 is spinning. The cap 147 may be removable, such as a nut or some equivalent structure.

If the second pill rotor 40 is stationary, the second pill rotor may or may not have a center hole 49. A center hole may be useful in order to synchronize the rotation of the first pill rotor 30 and the third pill rotor 50 by having a drive shaft (not shown) connected at the center of the first pill rotor 30 and third pill rotor 50. In this embodiment, the drive shaft extends through the hole 49 of the second rotor 40 but would not be engaged or touch the second rotor 40 so that the second rotor 40 remains stationary.

Figure 5A:
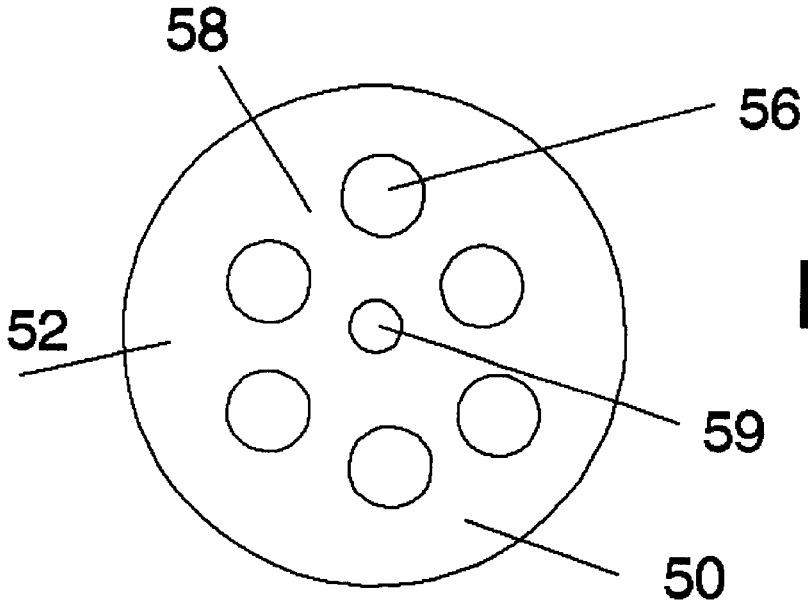
FIG. 5*a* is a top view of the third pill rotor.
Figure 5B:
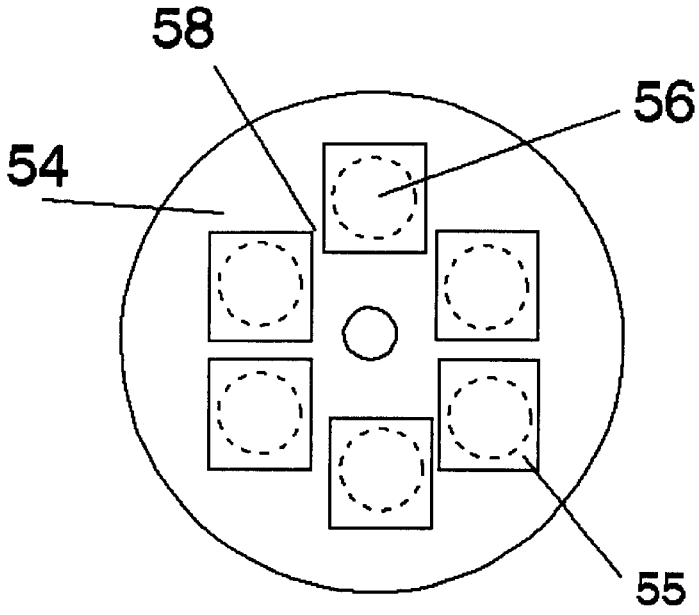
FIG. 5*b* is a bottom view of the third pill rotor.

Directly below the second pill rotor 40 is a third pill rotor 50. A second/third rotor gap of 0.05 to 2.0 cm (preferably 0.1 to 1.0 cm) is between the two rotors. The third pill rotor 50 is approximately 3.0 to 15.0 cm in diameter and has a depth ranging from 3.0 to 15.0 cm. The third pill rotor 50 has a top surface 52 and a bottom surface 54 as shown in FIGS. 5*a* and 5*b*. In addition, in this embodiment, the third pill rotor 50 has a plurality of chambers 56 (corresponding to the number of holes 36 in the first rotor 30), each chamber 56 having an opening on the top surface 52. A plurality of top and bottom interopening surfaces 58 are located between the openings. A trap door 55 is removably mounted on the bottom surface 54 of each chamber 56. Each door 55 may be engaged with guide grooves in the third rotor 50. Alternatively, the door 55 may simply be fastened by any nonpermanent means, such as tape, screws, Velcro, springs or the equivalent structures known to those skilled in the art.

The third pill rotor 50 is preferably mounted on a third mounting piece 154 that has a horizontal portion 155 and vertical portion 156. Again, it is important that the mounting piece 154 be of sufficient sturdiness and thickness such that it adequately supports the weight of the third rotor 50 when it is spinning at its highest speed.

The top of the vertical portion 156 may contain a cap 157 that precludes the third pill rotor 50 from flying off the mounting piece 154 when the rotor 50 is spinning. The cap 157 may be removable, such as a nut or some equivalent structure.

In one embodiment, the third pill rotor 50 is also rotatably mounted, preferably by a motor 150 with a belt 152. In addition, in this embodiment, the third pill rotor 50 is synchronized to rotate at the same speed as the first pill rotor 30.

In another embodiment, the rotation rate may be synchronized by having a drive shaft (not shown) extend between the two rotors so that the rotation is coupled. In such an embodiment, one motor (instead of two motors) is used to drive the first motor 130 and third motor 150.

Finally, in another embodiment, the third pill rotor 50 is synchronized to rotate at the same speed as the first pill rotor 30 by a gear mechanism. The gear may be mechanically or manually turned.

In all of these embodiments, the rotor 50 is positioned so that the holes 36 of the first rotor 30 are aligned with the top interopening surfaces 58 of the third rotor 50. Likewise, the bottom interhole surfaces 38 of the first rotor 30 are aligned with the chambers 56 of the third rotor 50.

The path of a pill taken in the pill counting machine 10 shall now be described. During operation, the pill is placed in the pill-receiving portion 22 of the funnel 20 (along with other pills). As the pill reaches the opening 26 of the neck portion 24, the pill will either (1) fall into a hole 36 of the first rotor 30 positioned directly underneath or (2) contact a top interhole surface 38 of the first rotor 30, thereby remaining in the neck portion 24 of the funnel 20 until a hole 36 is positioned directly underneath as the first rotor 30 continues to rotate. When the pill falls into the hole 36, the top surface 42 of the second rotor 40 prevents the pill from falling further. As the first rotor 30 continues to spin, the pill is carried in the hole 36 of the first rotor 30 until the hole is aligned with the single orifice 46 of the second rotor 40. At that point, the pill falls from the hole 36 of the first rotor 30 into the single orifice 46 of the second rotor 40. At that same instance, the top interopening surface 52 of the third rotor surface 58 is directly below the single orifice 46 of the second rotor 40. As the third rotor 50 continues to rotate, the single orifice 46 of the second rotor 40 is vertically aligned with a chamber 56 opening in the third rotor 50, permitting the pill to fall through the opening into a chamber 56 of the third rotor 50. The pills may then be removed using the trap door 55.

The number of pills in each chamber 56 can be easily determined simply by determining the number of rotations of the first rotor 30. For example, in this embodiment, after 200 complete rotations, 200 pills will reside in each of the six chambers 56. In addition, the number of pills in each chamber 56 can be combined in the event that less than six pill bottles are needed by the pharmacist. For example, if the pharmacist desires a single bottle with 200 pills, after 33 rotations, each of the six chambers 56 would hold 33 pills or 198 pills altogether (6×33=198). Thus, by combining the contents of all six chambers 56 and adding two pills, the pharmacist can easily count out 200 pills in approximately one-sixth of the time. A charter or computer algorithm can be drafted by one skilled in the art so that the pharmacist would not have to manually perform such calculations.

In order to accurately count the pills, no more pills should enter the three-rotor system after the requisite number has been counted. This may be accomplished by a braking mechanism and/or by having a trap door provided in the neck portion 24 of the funnel 20. The trap door may be manually or electronically operated.

While this invention is susceptible to various modifications and alternative forms, specific embodiments thereof have been shown by way of example in the drawings. It should be understood, however, that it is not intended to limit the invention to the particular forms described, but, on the contrary, the intention is to cover all modifications, equivalents, and alternatives falling within the spirit and scope of the invention as defined by the appended claims.

I claim:

1. A pill-counting machine comprising:

a housing;

a means for receiving pills;

a first pill rotor having a plurality of holes, wherein said first pill rotor is rotatably mounted to said housing;

a means for rotating said first pill rotor;

a second pill rotor having an orifice;

wherein said second pill rotor is mounted to said housing;

a third pill rotor having a plurality of chambers, wherein said third pill rotor is rotatably mounted to said housing; and a means for rotating said third pill rotor.

2. The pill-counting machine of claim 1 wherein said means for receiving pills comprises a funnel or a hopper.

3. The pill-counting machine of claim 1 wherein said means for rotating said first pill rotor comprises a motor and a belt.

4. The pill-counting machine of claim 1 wherein said first pill rotor has six holes.

5. The pill-counting machine of claim 1 wherein said means for rotating said first pill rotor and said means for rotating said third pill rotor comprises a motor and a drive shaft extending between said first pill rotor and said second pill rotor.

6. The pill-counting machine of claim 1 wherein said means for rotating said first pill rotor that operates at a predetermined speed and said means for rotating said third pill rotor comprise a motor that operates at that same speed.

7. The pill-counting machine of claim 1 wherein said first pill rotor is comprised of an inert plastic.

8. The pill-counting machine of claim 1 wherein said first pill rotor is rotably mounted to said housing by containing a first mounting piece, said mounting piece having a horizontal portion and a vertical portion.

9. The pill-counting machine of claim 8 wherein said vertical portion extends through a center hole in said first pill counter.

10. The pill counting machine of claim 9 wherein a cap is connected to said vertical portion.

11. A method for counting pills comprising:

providing a first rotor that is spinning at a predetermined speed, said first rotor having a plurality of holes;

providing a second rotor having an orifice below said first rotor;

providing a third rotor that is spinning at the predetermined speed, said third rotor having a plurality of chambers;

placing a single pill into a hole of said first rotor;

permitting the pill to fall into the orifice of said second rotor as the hole of said first rotor aligns with said orifice of said second rotor;

permitting the pill to fall into a third rotor as said orifice of said second rotor aligns with said chamber of said second rotor.

* * * * *